US012274373B2

(12) United States Patent
Birks

(10) Patent No.: US 12,274,373 B2
(45) Date of Patent: Apr. 15, 2025

(54) ADJUSTABLE LUMBAR SUPPORT MECHANISMS AND CHAIRS INCLUDING SAME

(71) Applicant: HNI Technologies Inc., Muscatine, IA (US)

(72) Inventor: Nathaniel Birks, Bettendorf, IA (US)

(73) Assignee: HNI Technologies Inc., Muscatine, IA (US)

( * ) Notice: Subject to any disclaimer, the term of this patent is extended or adjusted under 35 U.S.C. 154(b) by 72 days.

(21) Appl. No.: 17/899,790

(22) Filed: Aug. 31, 2022

(65) Prior Publication Data

US 2023/0065819 A1 Mar. 2, 2023

Related U.S. Application Data

(60) Provisional application No. 63/238,908, filed on Aug. 31, 2021.

(51) Int. Cl.
*A47C 7/46* (2006.01)

(52) U.S. Cl.
CPC ..... *A47C 7/462* (2013.01)

(58) Field of Classification Search
CPC ..... A47C 7/462; A47C 7/46
See application file for complete search history.

(56) References Cited

U.S. PATENT DOCUMENTS 2,369,076 A * 2/1945 Schmued ..... A47C 1/0325 297/375
4,565,406 A * 1/1986 Suzuki ..... A47C 7/462 297/284.4
4,566,733 A * 1/1986 Compton ..... A47C 7/14 297/452.23
4,725,095 A * 2/1988 Benson ..... A47C 7/462 297/284.1
4,934,755 A * 6/1990 Berghoff ..... B60N 2/643 297/284.1
5,860,700 A * 1/1999 Lance ..... A47C 7/462 297/284.8
5,871,258 A * 2/1999 Battey ..... A47C 1/03274 297/312
6,189,972 B1 2/2001 Chu et al.
7,517,024 B2 4/2009 Cvek
7,841,666 B2 11/2010 Schmitz et al.
(Continued)

*Primary Examiner* — David R Dunn
*Assistant Examiner* — Christopher E Veraa
(74) *Attorney, Agent, or Firm* — Faegre Drinker Biddle & Reath LLP

(57) ABSTRACT

A chair includes a back portion configured to engage a back of an occupant of the chair. The chair includes a frame and a conformable panel coupled to the frame. The conformable panel is configured to engage the back of the occupant of the chair, and the conformable panel includes a lumbar portion. A lumbar support mechanism is coupled to the frame. The lumbar support mechanism includes a base coupled to the frame and a lever pivotably coupled to the base. The lever comprises a shaft and a cam coupled to and being pivotable with the shaft relative to the base. A panel support translatably is coupled to the base and engaged with the cam. The lever is pivotable relative to the base to cause the cam to translate the panel support relative to the base and apply a force to the lumbar portion of the conformable panel.

11 Claims, 11 Drawing Sheets

(56) References Cited

U.S. PATENT DOCUMENTS

| | | | | |
|---|---|---|---|---|
| 7,878,591 | B2 | 2/2011 | Walker et al. | |
| 9,282,825 | B1 | 3/2016 | Rogers et al. | |
| 10,485,727 | B2 | 11/2019 | Grove | |
| 2007/0222265 | A1 | 9/2007 | Machael et al. | |
| 2013/0001993 | A1* | 1/2013 | Kurata | A47C 7/48<br>297/284.4 |
| 2017/0156501 | A1* | 6/2017 | Grove | A47C 7/462 |
| 2017/0354260 | A1* | 12/2017 | Aldrich | A47C 7/462 |
| 2023/0081447 | A1* | 3/2023 | Deng | A47C 7/462<br>297/301.4 |

* cited by examiner

ADJUSTABLE LUMBAR SUPPORT MECHANISMS AND CHAIRS INCLUDING SAME

CROSS-REFERENCE TO RELATED APPLICATION

The present application claims the benefit of and priority to, under 35 U.S.C. § 119(e), U.S. Provisional Application Ser. No. 63/238,908, filed Aug. 31, 2021, titled ADJUSTABLE LUMBAR SUPPORT MECHANISMS AND CHAIRS INCLUDING SAME, which is hereby incorporated by reference in its entirety for all purposes.

BACKGROUND

Chair manufacturers continually strive to improve the comfort, benefits, aesthetics, and manufacturability of the chairs they produce. Often, chairs have features, such as a reclining back, to increase comfort. Sometimes, chairs have features, such as adjustable seats, backs, back supports, armrests, and heights, to reduce or prevent injuries, including repetitive stress injury and back pain associated with sitting for long periods. Chairs are designed and built to meet an individual's needs and provide support where the individual needs it. In some chairs, the seat and back are fixed or the seat is fixed and the back tilts for comfort. In other chairs, the seat and back move together to support the occupant. Also, some chairs include a lumbar support mechanism for supporting the lower back or lumbar area of the occupant.

SUMMARY

In a first example, a chair includes a back portion configured to engage a back of an occupant of the chair. The chair includes a frame and a conformable panel coupled to the frame. The conformable panel is configured to engage the back of the occupant of the chair, and the conformable panel includes a lumbar portion. A lumbar support mechanism is coupled to the frame. The lumbar support mechanism includes a base coupled to the frame and a lever pivotably coupled to the base. The lever comprises a shaft and a cam coupled to and being pivotable with the shaft relative to the base. A panel support translatably is coupled to the base and engaged with the cam. The lever is pivotable relative to the base to cause the cam to translate the panel support relative to the base and apply a force to the lumbar portion of the conformable panel.

In a second example, the chair of the first example, wherein the panel support includes a support plate.

In a third example, the chair of one of the previous examples, wherein the lever is pivotable relative to the base about a pivot axis, the panel support is translatable relative to the base along a translation direction, and the translation direction is substantially perpendicular to the pivot axis.

In a fourth example, the chair of one of the previous examples, wherein the lumbar support mechanism is a first lumbar support mechanism coupled to a first side of the frame, the base is a first base, the lever is a first lever, the shaft is a first shaft, the cam is a first cam, and the panel support is a first panel support, and wherein the back portion further comprises a second lumbar support mechanism coupled to a second side of the frame. The second lumbar support mechanism includes a second base coupled to the frame. A second lever is pivotably coupled to the second base, and the second lever comprises a second shaft and a second cam coupled to and being pivotable with the second shaft relative to the second base. A second panel support is translatably coupled to the second base and engaged with the second cam. The second lever is pivotable relative to the second base to cause the second cam to translate the second panel support relative to the second base and apply a force to the lumbar portion of the conformable panel.

In a fifth example, the chair of one of the previous examples, wherein the lever extends through the base, and the cam is disposed on a side of the base proximate the panel support.

In a sixth example, the chair of one of the previous examples, wherein the lever further comprises a grip coupled to the shaft opposite the cam, and the grip is disposed on a side of the base opposite the panel support.

In a seventh example, a chair includes a back portion configured to engage a back of an occupant of the chair. The back portion comprises a frame and a conformable panel coupled to the frame. The conformable panel is configured to engage the back of the occupant of the chair, and the conformable panel comprises a lumbar portion. A lumbar support mechanism is coupled to the frame. The lumbar support mechanism includes a base coupled to the frame and a lever pivotably coupled to the base. The lever comprises a shaft and a cam coupled to and being pivotable with the shaft relative to the base. A panel support is translatably coupled to the base and engaged with the cam. The lever is pivotable relative to the base to cause the cam to slide along the panel support and translate the panel support from a first position to a second position. In the first position the panel support urges the lumbar portion of the conformable panel to occupy a first lumbar support configuration and in the second position the panel support urges the lumbar portion of the conformable panel to occupy a second lumbar support configuration.

In an eighth example, the chair of the seventh example, wherein the panel support comprises a support plate.

In a ninth example, the chair of one of the previous examples, wherein the lever is pivotable relative to the base about a pivot axis, the panel support is translatable relative to the base along a translation direction, and the translation direction is substantially perpendicular to the pivot axis.

In a tenth example, the chair of one of the previous examples, wherein the lumbar support mechanism is a first lumbar support mechanism coupled to a first side of the frame, the base is a first base, the lever is a first lever, the shaft is a first shaft, the cam is a first cam, and the panel support is a first panel support, and wherein the back portion further comprises a second lumbar support mechanism coupled to a second side of the frame. The second lumbar support mechanism includes a second base coupled to the frame and a second lever pivotably coupled to the second base. The second lever comprises a second shaft and a second cam coupled to and being pivotable with the second shaft relative to the second base. A second panel support is translatably coupled to the second base and engaged with the second cam. The second lever is pivotable relative to the second base to cause the second cam to slide along the second panel support and translate the second panel support from a first position to a second position. In the first position the second panel support urges the lumbar portion of the conformable panel to occupy a first lumbar support configuration and in the second position the second panel support urges the lumbar portion of the conformable panel to occupy a second lumbar support configuration.

In an eleventh example, a chair includes a back portion configured to engage a back of an occupant of the chair. The back portion includes a frame and a conformable panel coupled to the frame and configured to engage the back of the occupant of the chair. The conformable panel comprises a lumbar portion. A lumbar support mechanism is coupled to the frame. The lumbar support mechanism comprises a base coupled to the frame and a leg pivotably coupled to the base. The leg includes an upper leg portion configured to be pivoted by a user relative to the base. A foot portion is coupled to and pivotable with the upper leg portion relative to the base. The foot portion comprises a heel portion and a toe portion. A panel support is translatably coupled to the base and engaged with the foot portion. The leg is pivotable relative to the base to cause the toe portion to slide against the panel support and translate the panel support relative to the base, and the panel support thereby applies a force to the lumbar portion of the conformable panel.

In a twelfth example, the chair of the eleventh example, wherein the panel support comprises a support plate.

In a thirteenth example, the chair of one of the previous examples, wherein the leg is pivotable relative to the base about a pivot axis, the panel support is translatable relative to the base along a translation direction, and the translation direction is substantially perpendicular to the pivot axis.

In a fourteenth example, the chair of one of the previous examples, wherein the lumbar support mechanism is a first lumbar support mechanism coupled to a first side of the frame, the base is a first base, the leg is a first leg, the upper leg portion is a first upper leg portion, the foot portion is a first foot portion, the heel portion is a first heel portion, the toe portion is a first toe portion, and the panel support is a first panel support, and wherein the back portion further comprises a second lumbar support mechanism coupled to a second side of the frame. The second lumbar support mechanism includes a second base coupled to the frame and a second leg pivotably coupled to the second base. The second leg includes a second upper leg portion configured to be pivoted by a user relative to the second base. A second foot portion is coupled to and pivotable with the second upper leg portion relative to the second base. The second foot portion comprises a second heel portion and a second toe portion. A second panel support is translatably coupled to the second base and engaged with the second foot portion. The second leg is pivotable relative to the second base to cause the second foot portion to slide against the second panel support and translate the second panel support relative to the second base, the second panel support thereby applying a force to the lumbar portion of the conformable panel.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
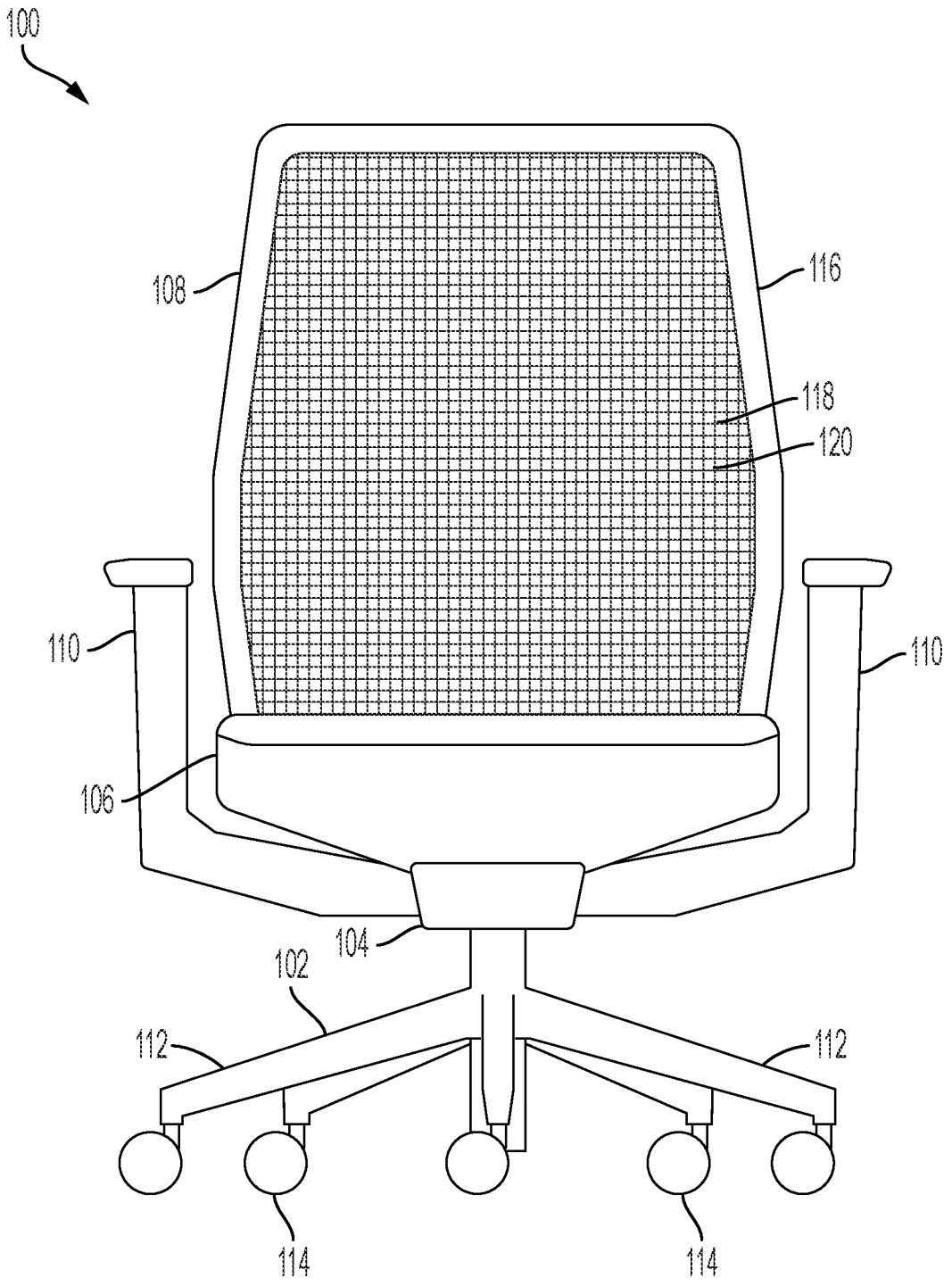
FIG. 1 is a front view of a chair according to an embodiment of the present invention.

It should be understood that the drawings are intended facilitate understanding of exemplary embodiments of the present invention are not necessarily to scale.

DETAILED DESCRIPTION

The following description refers to the accompanying drawings which show specific embodiments. Although specific embodiments are shown and described, it is to be understood that additional or alternative features are employed in other embodiments. The following detailed description is not to be taken in a limiting sense, and the scope of the claimed invention is defined by the appended claims and their equivalents.

It should be understood that like reference numerals are intended to identify the same structural components, elements, portions, or surfaces consistently throughout the several drawing figures, as such components, elements, portions, or surfaces may be further described or explained by the entire written specification, of which this detailed description is an integral part. Unless otherwise indicated, the drawings are intended to be read (for example, cross-hatching, arrangement of parts, proportion, degree, etc.) together with the specification, and are to be considered a portion of the written description.

Generally, chairs according to some embodiments of the present invention include a conformable back panel (for example, formed by one or more meshes, thin and flexible polymers, thermoplastics, and the like) that are supported by a frame. The chairs further include one or more lumbar support mechanisms for applying supportive forces to a lumbar portion of the conformable back panel. The lumbar support mechanisms thereby support the lower back or lumbar area of an occupant. Additionally, the lumbar support mechanisms are adjustable to provide different amounts of support and thereby accommodate different occupant needs and/or preferences.

FIG. 1 illustrates front view of a chair 100 according to an embodiment of the present invention. Generally, the chair 100 includes a base 102, a hub 104, a seat portion 106, a back portion 108, and armrests 110. The base 102 supports the chair 100, including the hub 104, the seat portion 106, and the back portion 108, on a surface, such as a floor of a building. The hub 104 is connected to the base 102, and the seat portion 106 and the back portion 108 are connected to and supported by the hub 104. In some embodiments and as illustrated, the armrests 110 are attached to the hub 104. In some embodiments, the armrests 110 are attached to the seat portion 106 or the back portion 108. In some embodiments, the chair 100 lacks the armrests 110.

The base 102 includes a plurality of legs 112 (illustratively, five legs 112) for supporting the chair 100 on the surface. In some embodiments and as illustrated, each of the legs 112 includes one or more casters or wheels 114 for rolling the chair 100 on the surface. In some embodiments, each of the legs 112 lacks the wheels 114 and includes a foot (not shown), such that the chair 100 does not roll on the surface.

In some embodiments, the hub 104 is rotatably connected to the base 102, such that the seat portion 106 and the back portion 108 swivel on the base 102 via the hub 104. In some embodiments, the hub 104 includes a lever arm (not shown) for adjusting the height of the seat portion 106 and/or the back portion 108. In some embodiments, the hub 104 includes a weight activated control mechanism (not shown) for raising and lowering the seat portion 106 in response to the occupant leaning or applying force to the back portion 108.

The seat portion 106 supports the legs of an occupant and the armrests 110 support the arms of the occupant. In some embodiments, the height of each of the armrests 110 is adjustable to accommodate occupants of different sizes.

The back portion 108 engages the back of an occupant. The back portion 108 includes a frame 116 that may be constructed of various materials, such as metals, polymers, or the like. The frame 116 defines the perimeter of the back portion 108 and carries a conformable panel 118. The conformable panel 118 may be constructed of various materials, such as a mesh, a flexible polymer, or the like. The conformable panel 118 obscures the interior of the frame 116 and provides a front surface 120 for engaging the back of the occupant.

Figure 2:
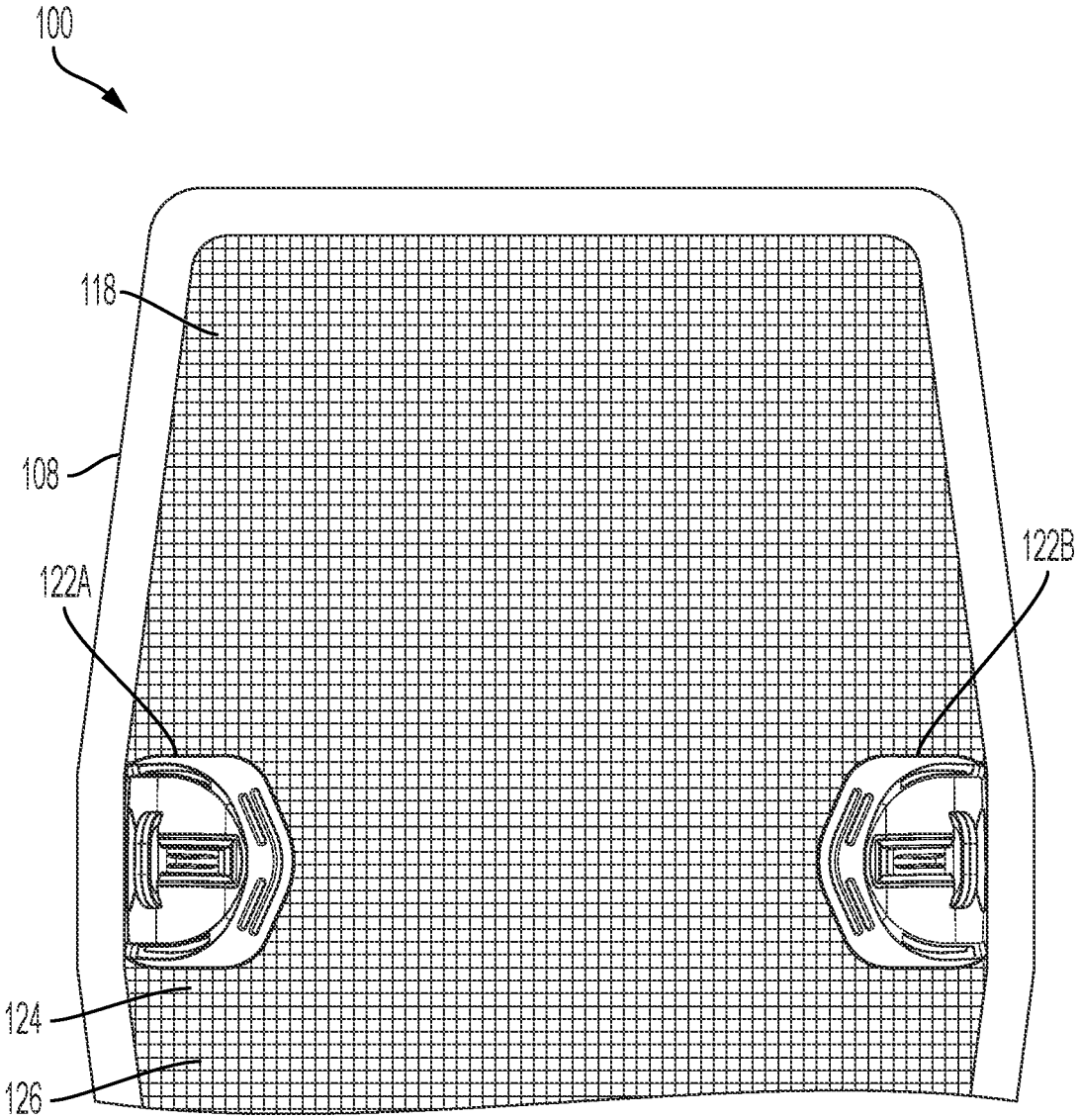
FIG. 2 is a partial rear view of a back portion of the chair of FIG. 1.
Figure 3:
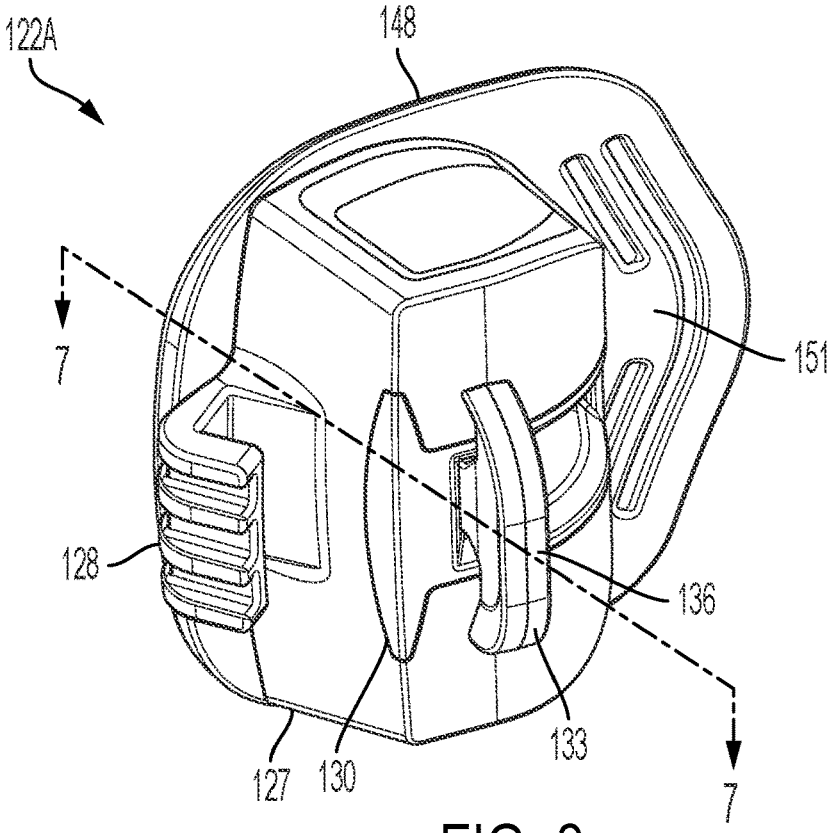
FIG. 3 is a rear perspective view of a lumbar support mechanism of the chair of FIG. 1, illustrating the lumbar support mechanism in a first position.
Figure 4:
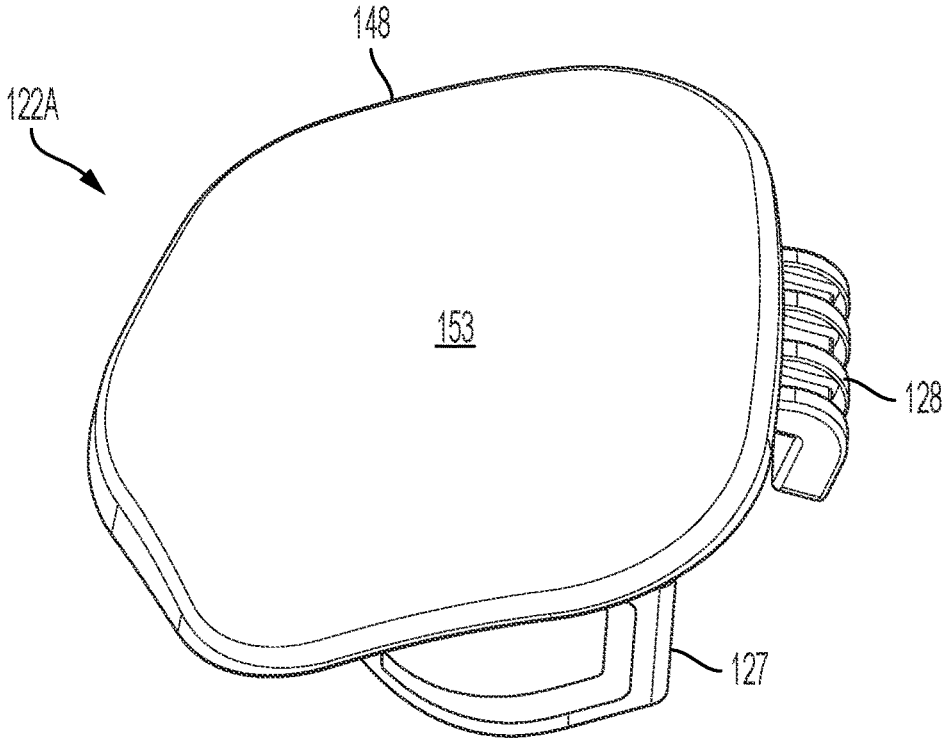
FIG. 4 is a front perspective view of the lumbar support mechanism of FIG. 3, illustrating the lumbar support mechanism in the first position.

FIG. 2 illustrates a rear partial view of the back portion 108 of the chair 100. The back portion 108 includes first and second lumbar support mechanisms 122A and 122B proximate a lumbar portion 124 of the conformable panel 118. Generally, the lumbar support mechanisms 122A and 122B press against a rear surface 126 of the conformable panel 118 and cause the lumbar portion 124 of the conformable panel 118 to protrude forward relative to other portions of the of the conformable panel 118. As a result, the front surface 120 of the conformable panel 118 (shown elsewhere) thereby engages and support the lumbar area of the occupant. Additionally, the lumbar support mechanisms 122A and 122B are movable to different positions to provide different amounts of support. These aspects of the lumbar support mechanisms 122A and 122B are described in further detail below.

Figure 8:
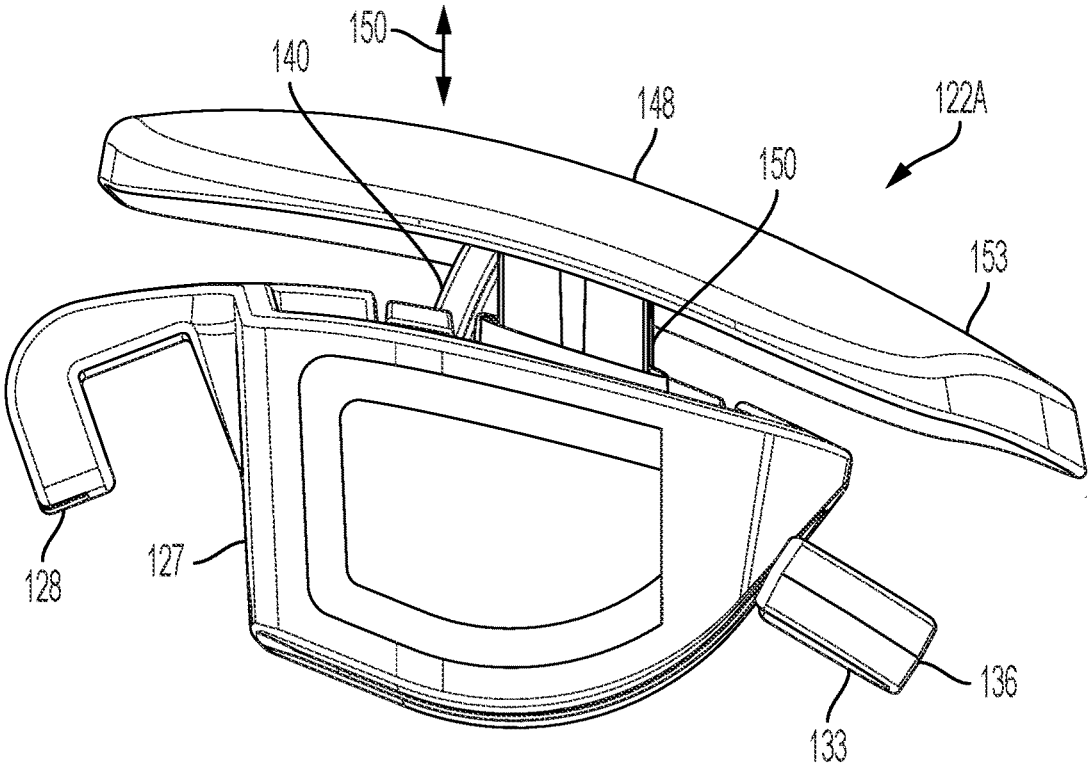
FIG. 8 is a top view of the lumbar support mechanism of FIG. 3, illustrating the lumbar support mechanism in a second position.
Figure 9:
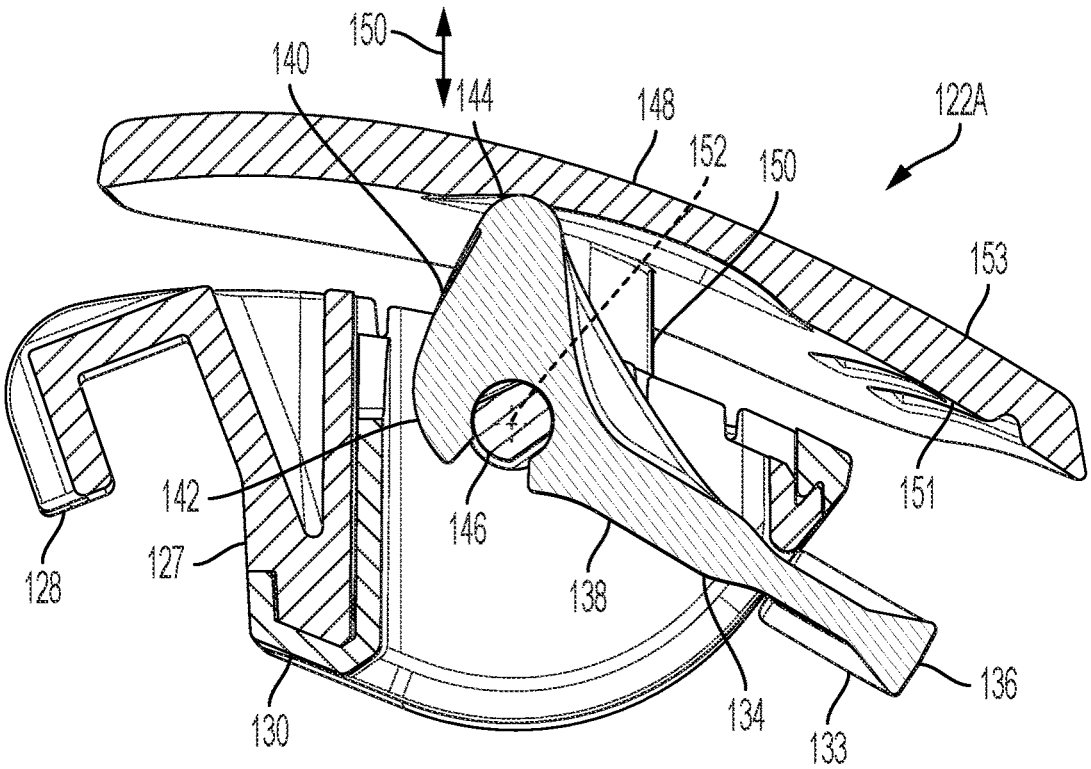
FIG. 9 is a top section view of the lumbar support mechanism similar to FIG. 7, but illustrating the lumbar support mechanism in the second position.

Referring now to FIGS. 3-9, the first lumbar support mechanism 122A is shown in further detail. The second lumbar support mechanism 122B may be, for example, a mirror image of the first lumbar support mechanism 122A, but otherwise substantially similar, such that the second lumbar support mechanism 122B could be described with reference to FIGS. 3-9. FIGS. 3, 4, 6, and 7 illustrate the first lumbar support mechanism 122A in a first position, and FIGS. 8 and 9 illustrate the first lumbar support mechanism 122A moved to a second position. In the first position, the first lumbar support mechanism 122A causes the lumbar portion 124 of the conformable panel 118 (shown elsewhere) to occupy a first lumbar support configuration, which may also be referred to as a "low pressure" configuration. In the second position, the first lumbar support mechanism 122A urges the lumbar portion 124 of the conformable panel 118 (shown elsewhere) to occupy a second lumbar support configuration, which may also be referred to as a "high pressure" configuration. The lumbar portion 124 of the conformable panel 118 is positioned further forward in the high pressure configuration than the low pressure configuration and thereby provides more lumbar support in the high pressure configuration than the low pressure configuration.

Figure 5:
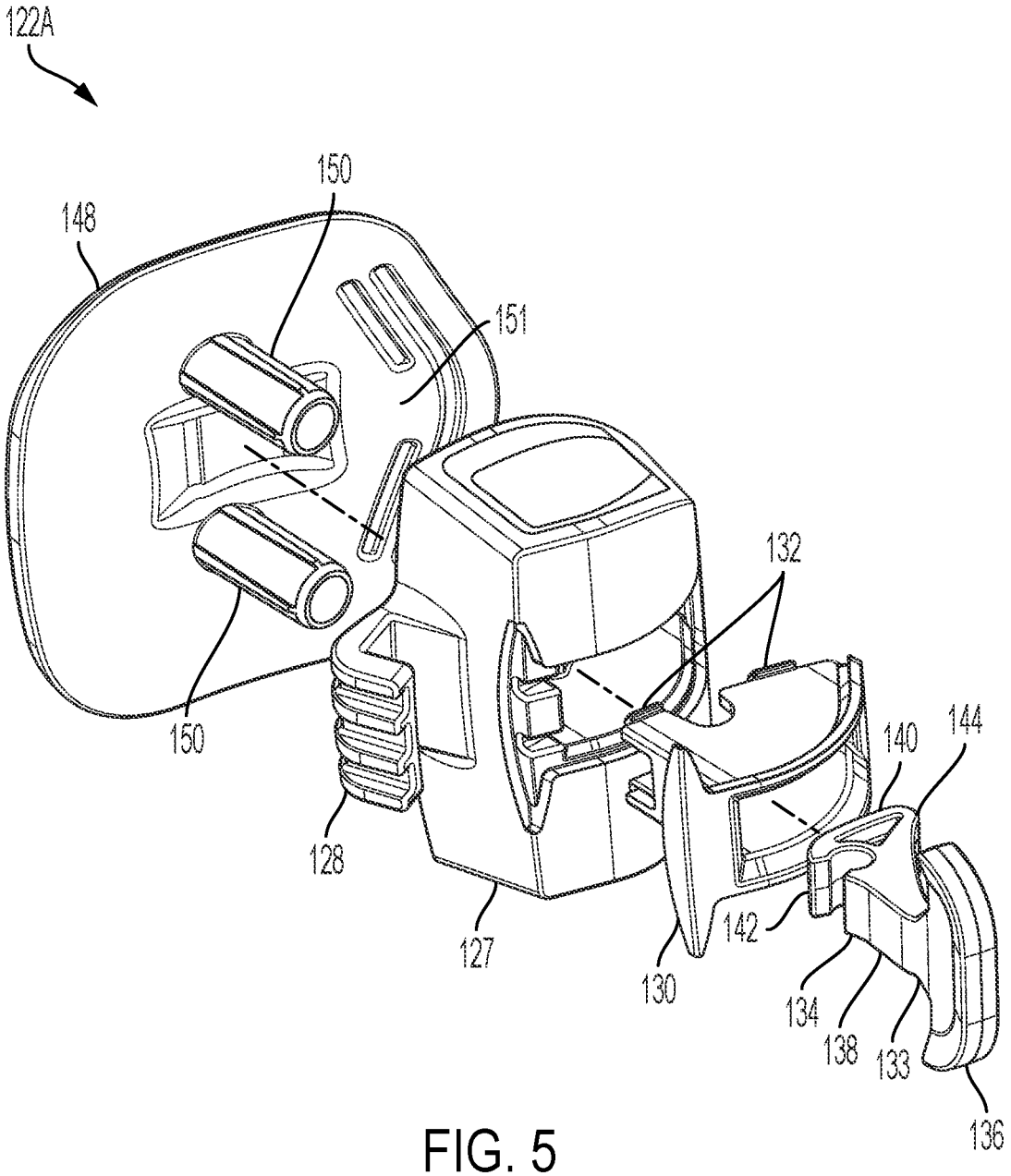
FIG. 5 is an exploded rear perspective view of the lumbar support mechanism of FIG. 3.
Figure 6:
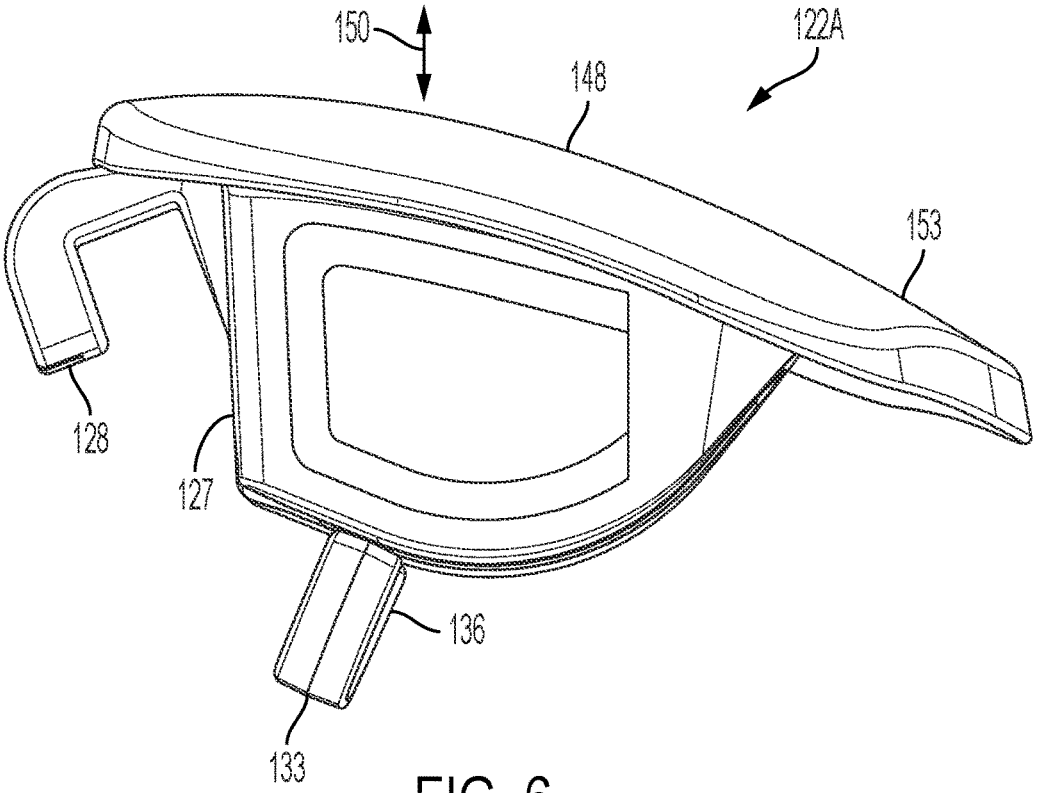
FIG. 6 is a top view of the lumbar support mechanism of FIG. 3, illustrating the lumbar support mechanism in the first position.
Figure 7:
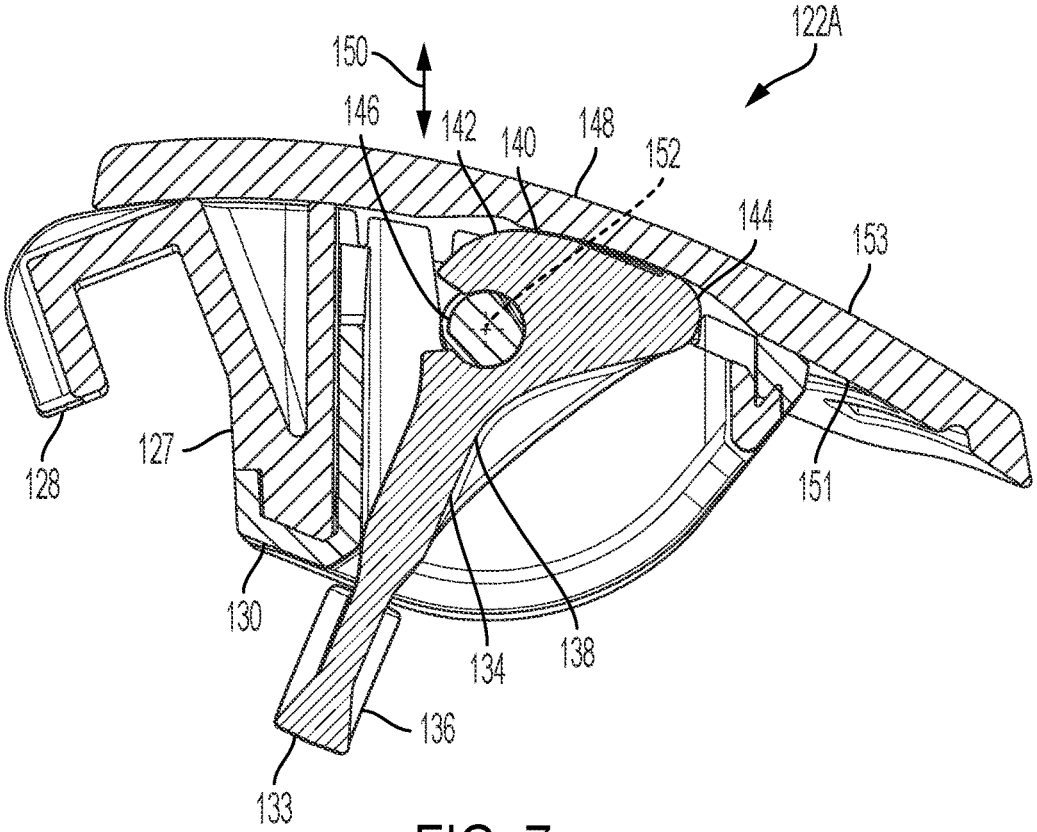
FIG. 7 is a top section view of the lumbar support mechanism along line 7-7 of FIG. 3, illustrating the lumbar support mechanism in the first position.

With continued reference to FIGS. 3-9, the first lumbar support mechanism 122A includes a base 127 having one or more mounts 128 for securing the first lumbar support mechanism 122A to the frame 116 (shown elsewhere). Illustratively, the base 127 includes one mount 128 having a general hook shape. In other embodiments, the base 127 includes a different number of mounts 128 and/or mounts having different forms. The base 127 couples to a lever guide 130. Illustratively and as shown in FIG. 5, the lever guide 130 couples to the base 127 via a plurality of snap connectors 132. In other embodiments, the lever guide 130 couples to the base 127 in other manners, or the lever guide 130 is monolithically formed with the base 127.

With continued general reference to FIGS. 3-9 and specific reference to FIGS. 5, 8, and 9, the base 127 pivotably carries a user-operable mechanism 133 for moving the lumbar support mechanism 122A from the first position to the second position and vice versa. Illustratively, the user-operable mechanism 133 includes a lever 134, which may also be referred to as a leg, that extends into the lever guide 130 and pivotably carried by the base 127. The lever 134 includes a grip 136 that is disposed externally from the lever guide 130 and graspable by a user (such as the chair's occupant or another person). The grip 136 couples to a shaft 138, which may also be referred to as an upper leg, that extends into the lever guide 130. Opposite the grip 136, the shaft 138 couples to a cam 140, which may also be referred to as a foot having a heel portion 142 and a toe portion 144. The cam 140 pivotably couples to a pivot rod 146 (see FIGS. 7 and 9) carried by the base 127. The pivot rod 146 facilitates pivoting of the grip 136, the shaft 138, and the cam 140 together relative to the base 127.

With continued general reference to FIGS. 3-9 and specific reference to FIGS. 5-9, the lever 134 operatively engages a panel support 148 that is translatably carried by the base 127, via one or more support rods 150. The user may pivot the lever 134 relative to the base 127 to cause the cam 140 to slide along and translate the panel support 148 relative to the base 127. The panel support 148 thereby bears against the lumbar portion 124 of the conformable panel 118 (shown elsewhere). More specifically, in the first position of the first lumbar support mechanism 122A, as shown in FIGS. 3, 4, 6, and 7, the heel portion 142 of the cam 140 (see FIG. 7) contacts a rear surface 151 of the panel support 148. The conformable panel 118 contacts a front surface 153 of the panel support 148 and holds the panel support 148 against the base 127 (for example, due to tension in the conformable panel 118). As a result, the panel support 148 causes the lumbar portion 124 of the conformable panel 118 to occupy the first lumbar support or low pressure configuration. In the second position of the first lumbar support mechanism 122A, as shown in FIGS. 8 and 9, the toe portion 144 of the cam 140 (see FIG. 9) contacts the rear surface 151 of the panel support 148 and holds the panel support 148 in an extended position relative to the base 127. The front surface 153 of the panel support 148 contacts and displaces the conformable panel 118. As a result, the panel support 148 causes the lumbar portion 124 of the conformable panel 118 to occupy the second lumbar support or high pressure configuration.

In some embodiments, the lever 134 may be stable in the first position and the second position of the first lumbar support mechanism 122A and unstable in intermediate positions. If the lever 134 is released by the user in one of the intermediate positions, the first lumbar support mechanism 122A may be urged to return to the first position or the second position (for example, due to tension in the conformable panel 118), for example, the nearer of the first position and the second position. In other embodiments, the lever 134 may also be stable in one or more of the intermediate positions.

In some embodiments and as illustrated, the panel support 148 may translate in a direction that is substantially perpendicular to the pivot axis of the lever 134. More specifically, the panel support 148 translates relative to the base 127 in a translation direction 150 (see FIGS. 6-9), the lever 134 pivots relative to the base 127 about a pivot axis 152 (see FIGS. 7 and 9) defined by the pivot rod 146, and the translation direction 150 is substantially perpendicular to the pivot axis 152 (as used herein, "substantially perpendicular" meaning perpendicular ±5 degrees). The panel support may take a variety of forms. For example and as illustrated, the panel support may be a support plate. In other embodiments, the panel support may have different shapes.

Figure 10:
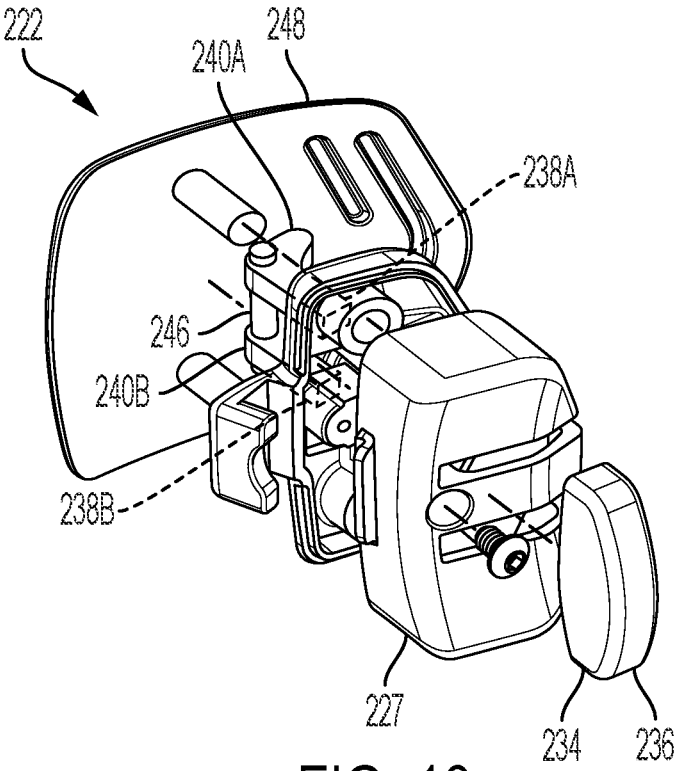
FIG. 10 is an exploded rear perspective view of a lumbar support mechanism according to another embodiment of the present invention.
Figure 11:
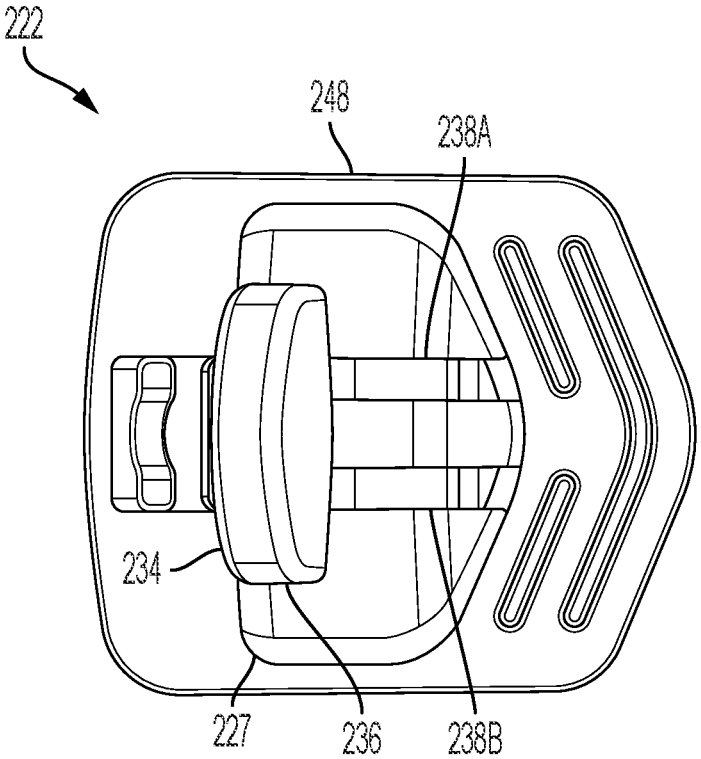
FIG. 11 is a rear view of the lumbar support mechanism of FIG. 10.

FIGS. 10 and 11 illustrate another first lumbar support mechanism 222 according to an embodiment of the present invention. The first lumbar support mechanism 222 may be used as part of the chair 100 (shown elsewhere) instead of the first lumbar support mechanism 122A. A second lumbar support mechanism (not shown) coupled to the opposite side of the chair 100 may be, for example, a mirror image of the first lumbar support mechanism 222, but otherwise substantially similar, such that the second lumbar support mechanism could be described with reference to FIGS. 10 and 11. Generally, the first lumbar support mechanism 222 includes a base 227 that pivotably carries a lever 234 and a panel support 248. The base 227 and the panel support 248 may be similar to the base 127 and the panel support 148 described above, respectively. The lever 234 includes a grip 236 that is disposed externally from the base 227 and graspable by a user. The grip 236 couples to an upper shaft 238A and a lower shaft 238B that extend into the base 227. Opposite the grip 236, the upper shaft 238A couples to an upper cam 240A and the lower shaft 238B couples to a lower cam 240B, and the cams 240A and 240B are coupled by a common pivot rod 246 (see FIG. 10). The pivot rod 246 is pivotably carried by the base 227, and the pivot rod 246 facilitates pivoting of the grip 236, the shafts 238A and 238B, and the cams 240A and 240B together relative to the base 227. The lever 234 may be manipulated by the user to operate the first lumbar support mechanism 222 in a similar manner to the first lumbar support mechanism 122A, as described above.

Figure 13:
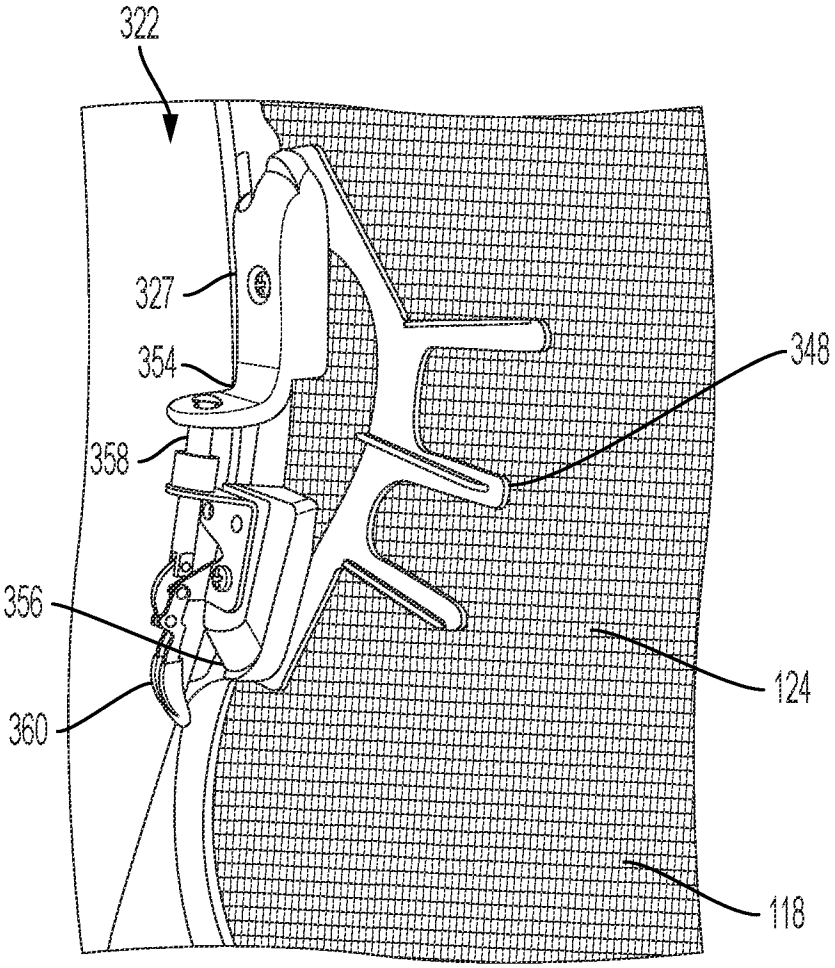
FIG. 13 is another rear perspective view of the chair of FIG. 1 and the lumbar support mechanism of FIG. 12, illustrating the lumbar support mechanism in a second position.
Figure 12:
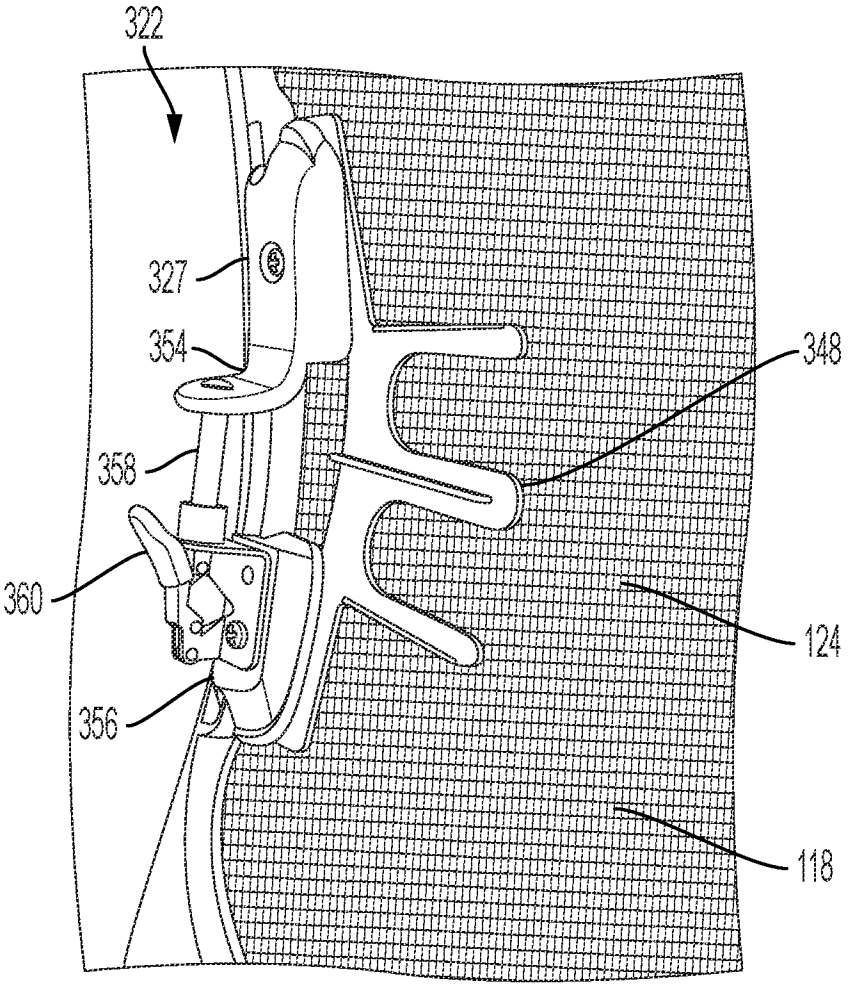
FIG. 12 is a rear perspective view of the chair of FIG. 1 and a lumbar support mechanism according to another embodiment of the present invention, illustrating the lumbar support mechanism in a first position.

FIGS. 12 and 13 illustrate another first lumbar support mechanism 322 according to an embodiment of the present invention. The first lumbar support mechanism 322 may be used as part of the chair 100 instead of the first lumbar support mechanism 122A. A second lumbar support mechanism (not shown) coupled to the opposite side of the chair 100 may be, for example, a mirror image of the first lumbar support mechanism 322, but otherwise substantially similar, such that the second lumbar support mechanism could be described with reference to FIGS. 12 and 13. Generally, the first lumbar support mechanism 322 includes a base 327 that carries a panel support 348. The base 327 includes a first portion 354 and a second portion 356 that couple to opposite ends of the panel support 348. The first portion 354 also couples to a rod 358 that is translatably received by the second portion 356. A pivotable lever 360 couples to the rod 358 and is pivoted to pull the rod 358 relative to the second portion 356. This action pulls the first portion 354 toward the second portion 356, which causes the panel support 348 to flex. The panel support 348 thereby pushes the lumbar portion 124 of the conformable panel 118 forward and increases lumbar support provided by the conformable panel 118.

Figure 15:
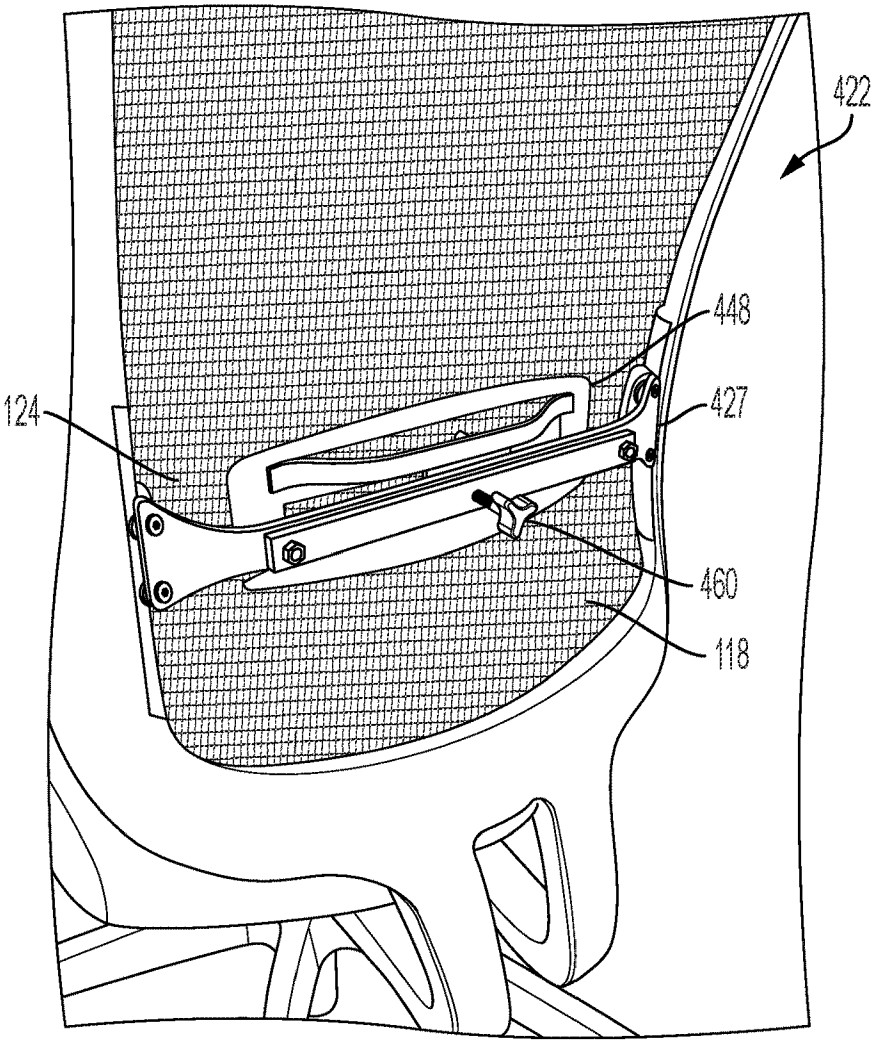
FIG. 15 is another rear perspective view of the chair of FIG. 1 and the lumbar support mechanism of FIG. 14, illustrating the lumbar support mechanism in a second position.
Figure 14:
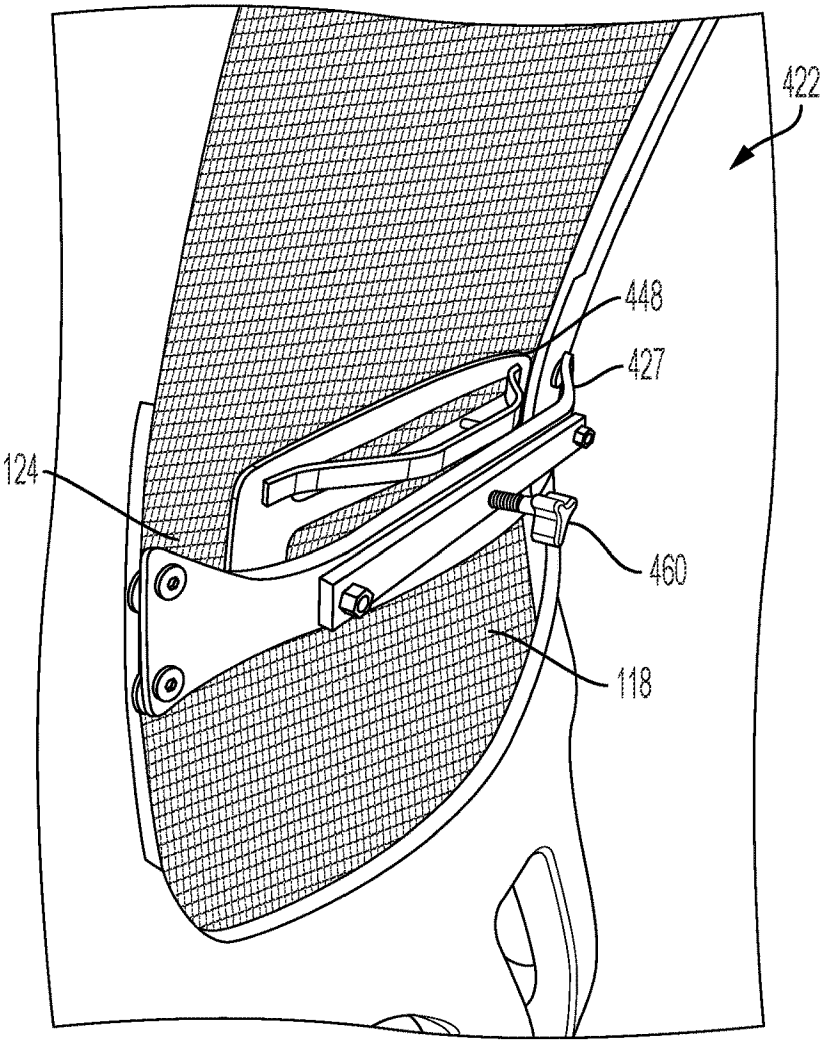
FIG. 14 is a rear perspective view of the chair of FIG. 1 and a lumbar support mechanism according to another embodiment of the present invention, illustrating the lumbar support mechanism in a first position.

FIGS. 14 and 15 illustrate another lumbar support mechanism 422 according to an embodiment of the present invention. The lumbar support mechanism 422 may be used as part of the chair 100 instead of the first lumbar support mechanism 122A and the second lumbar support mechanism 122B. Generally, the lumbar support mechanism 422 includes a base 427 that threadably couples to a fastener 460, and the fastener 460 couples to a panel support 448. The fastener 460 may be rotated relative to the base 427 to advance the fastener 460 relative to the base 427. This action pushes the panel support 448 toward the lumbar portion 124 of the conformable panel 118. The lumbar portion 124 of the conformable panel 118 thereby moves forward and increases lumbar support provided by the conformable panel 118.

Figure 17:
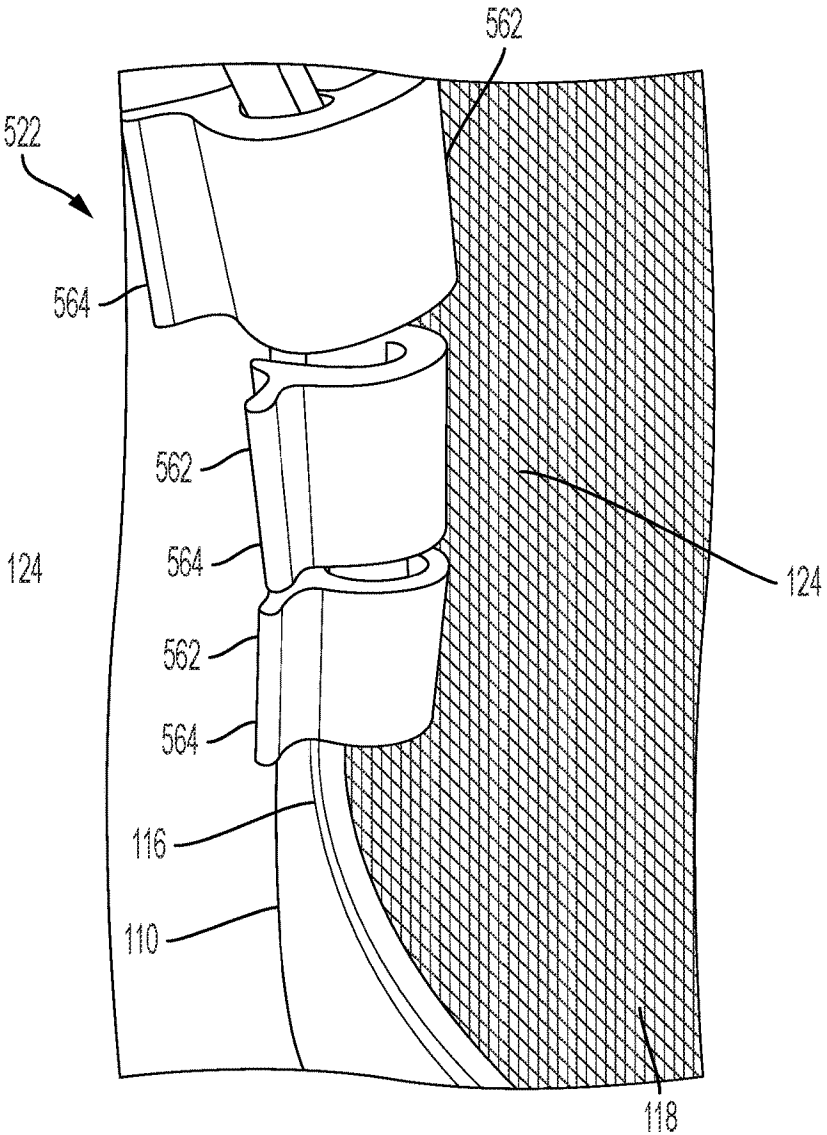
FIG. 17 is another rear perspective view of the chair of FIG. 1 and the lumbar support mechanism of FIG. 16, illustrating the lumbar support mechanism in a second position.
Figure 16:
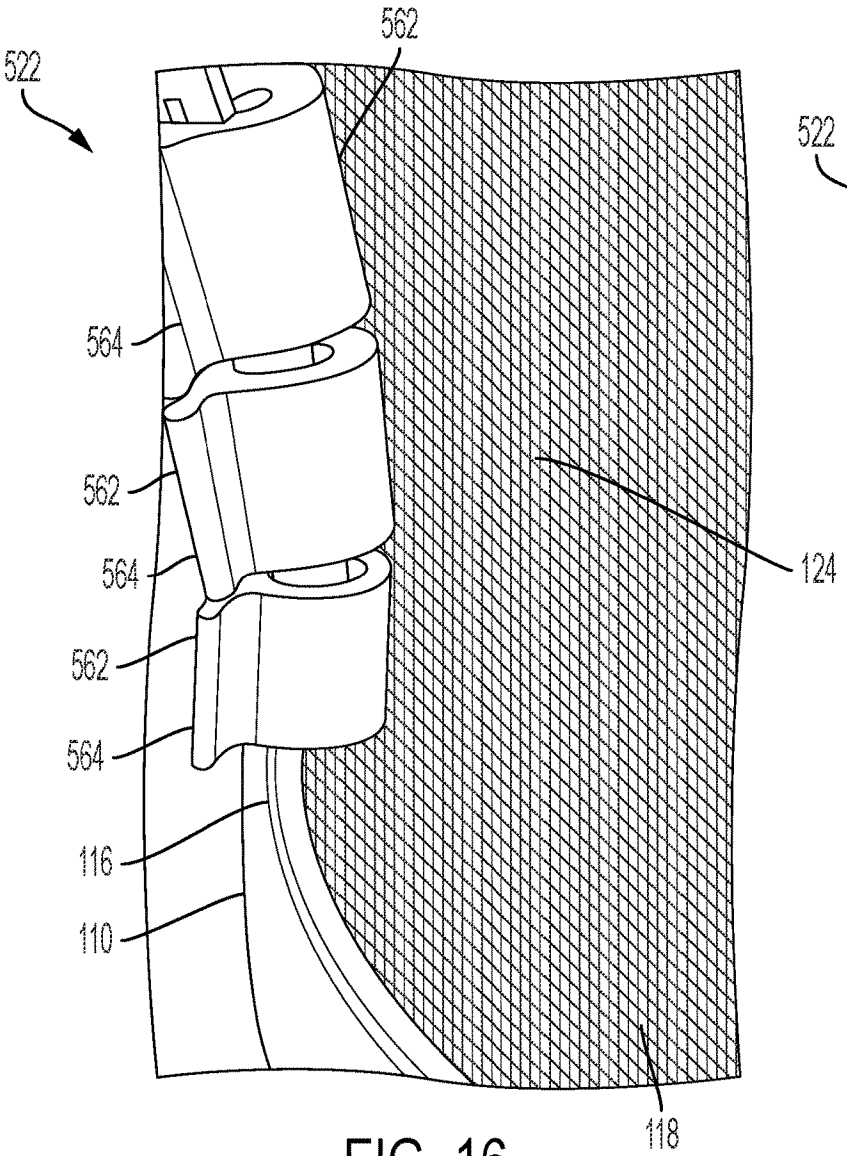
FIG. 16 is a rear perspective view of the chair of FIG. 1 and a lumbar support mechanism according to another embodiment of the present invention, illustrating the lumbar support mechanism in a first position.

FIGS. 16 and 17 illustrate another first lumbar support mechanism 522 according to an embodiment of the present invention. The first lumbar support mechanism 522 may be used as part of the chair 100 instead of the first lumbar support mechanism 122A. A second lumbar support mechanism (not shown) coupled to the opposite side of the chair 100 may be, for example, a mirror image of the first lumbar support mechanism 522, but otherwise substantially similar, such that the second lumbar support mechanism could be described with reference to FIGS. 16 and 17. Generally, the first lumbar support mechanism 522 includes one or more (illustratively, three) independently pivotable cams 562 that couple to the frame 116 of the chair 100. Each cam 562 may be pivoted relative to the frame 116 from a first position to a second position to push the lumbar portion 124 of the conformable panel 118 forward and increase lumbar support provided by the conformable panel 118. In some embodiments, each cam 562 includes a grip 564 to facilitate pivoting the cam 562 relative to the frame 116.

Figure 18:
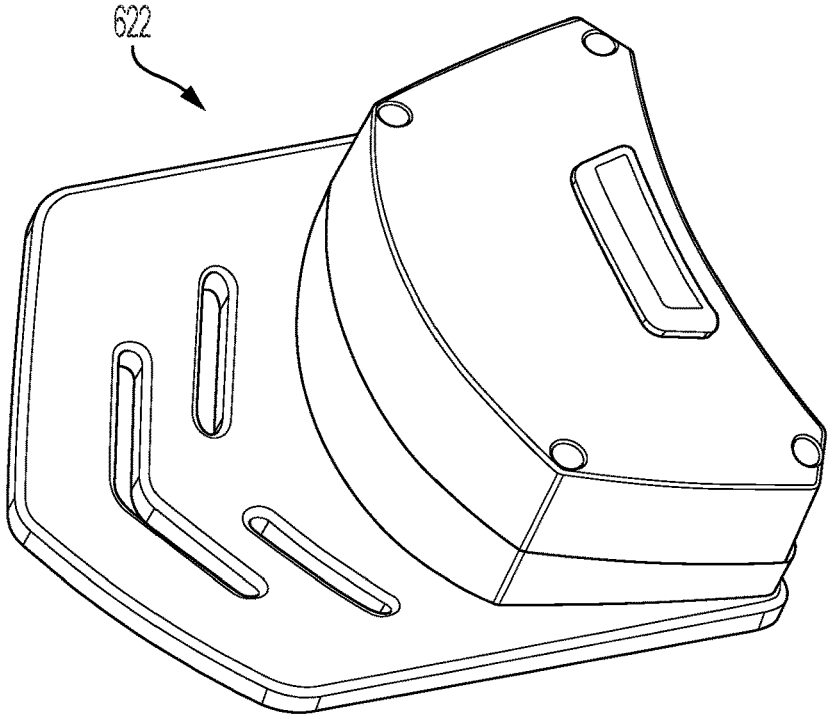
FIG. 18 is a rear perspective view of a lumbar support mechanism according to another embodiment of the present invention.
Figure 19:
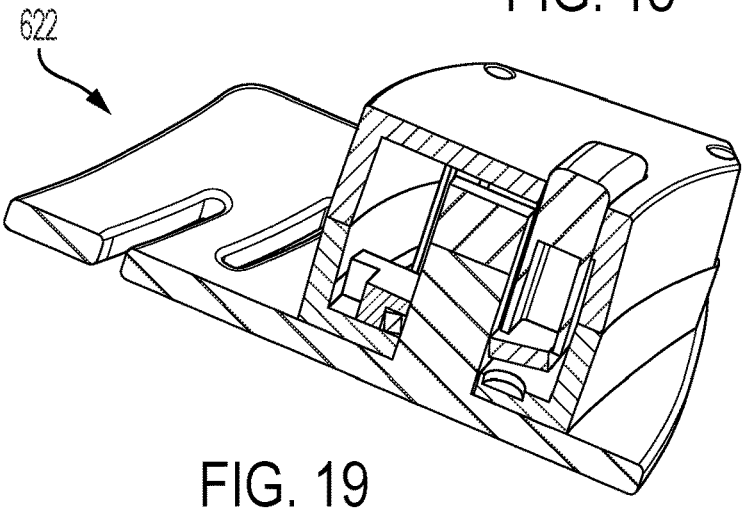
FIG. 19 is a transverse sectional rear perspective view of the lumbar support mechanism of FIG. 18, illustrating the lumbar support mechanism in a first position.
Figure 20:
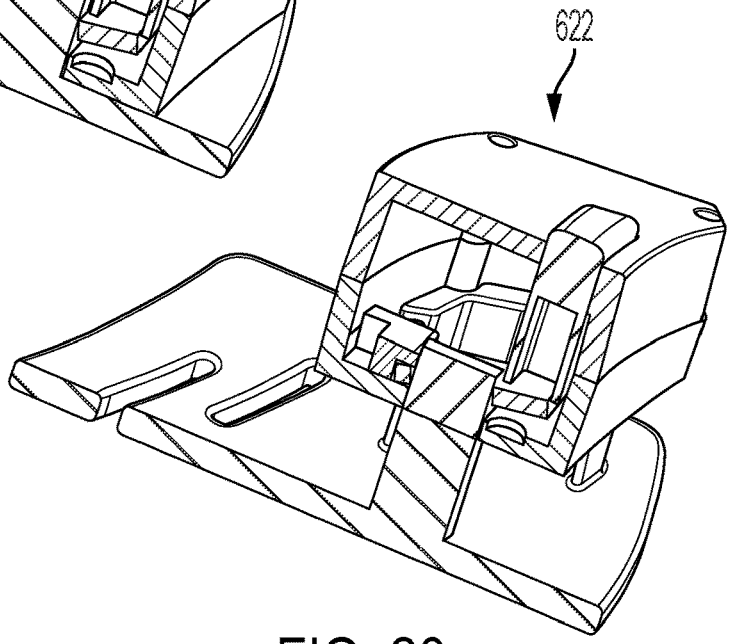
FIG. 20 is a transverse sectional rear perspective view of the lumbar support mechanism of FIG. 18, illustrating the lumbar support mechanism in a second position.

FIGS. 18-20 illustrate another first lumbar support mechanism 622 according to an embodiment of the present invention. The first lumbar support mechanism 622 may be used as part of the chair 100 (shown elsewhere) instead of the first lumbar support mechanism 122A. A second lumbar support mechanism (not shown) coupled to the opposite side of the chair 100 may be, for example, a mirror image of the first lumbar support mechanism 622, but otherwise substantially similar, such that the second lumbar support mechanism could be described with reference to FIGS. 18-20.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed is:

1. A chair comprising:

a back portion configured to engage a back of an occupant of the chair, comprising:

a frame;

a conformable panel coupled to the frame and configured to engage the back of the occupant of the chair, the conformable panel comprising a lumbar portion;

a lumbar support mechanism coupled to the frame, the lumbar support mechanism comprising:

a base coupled to the frame;

a lever pivotably coupled to the base, the lever comprising a shaft and a cam coupled to and being pivotable with the shaft relative to the base; and a panel support translatably coupled to the base and engaged with the cam, the panel support including a support rod slidable relative to the base and a support plate, wherein the lever is pivotable relative to the base to cause the cam to translate the support rod and the support plate relative to the base and apply a force to the lumbar portion of the conformable panel.

2. The chair of claim 1, wherein the lever is pivotable relative to the base about a pivot axis, the panel support is translatable relative to the base along a translation direction, and the translation direction is substantially perpendicular to the pivot axis.

3. The chair of claim 1, wherein the lumbar support mechanism is a first lumbar support mechanism coupled to a first side of the frame, the base is a first base, the lever is a first lever, the shaft is a first shaft, the cam is a first cam, and the panel support is a first panel support, and wherein the back portion further comprises a second lumbar support mechanism coupled to a second side of the frame, the second lumbar support mechanism comprising:

a second base coupled to the frame;

a second lever pivotably coupled to the second base, the second lever comprising a second shaft and a second cam coupled to and being pivotable with the second shaft relative to the second base; and a second panel support translatably coupled to the second base and engaged with the second cam, wherein the second lever is pivotable relative to the second base to cause the second cam to translate the second panel support relative to the second base and apply a force to the lumbar portion of the conformable panel.

4. The chair of claim 1, wherein the lever extends through the base, and the cam is disposed on a side of the base proximate the panel support.

5. The chair of claim 4, wherein the lever further comprises a grip coupled to the shaft opposite the cam, and the grip is disposed on a side of the base opposite the panel support.

6. A chair, comprising:

a back portion configured to engage a back of an occupant of the chair, comprising:

a frame;

a conformable panel coupled to the frame and configured to engage the back of the occupant of the chair, the conformable panel comprising a lumbar portion;

a lumbar support mechanism coupled to the frame, the lumbar support mechanism comprising:

a base coupled to the frame;

a lever pivotably coupled to the base, the lever comprising a shaft and a cam coupled to and being pivotable with the shaft relative to the base; and a panel support translatably coupled to the base and engaged with the cam, the panel support comprising a support plate, wherein the lever is pivotable relative to the base to cause the cam to slide along the support plate and translate the support plate from a first position to a second position, in the first position the panel support urging the lumbar portion of the conformable panel to occupy a first lumbar support configuration and in the second position the panel support urging the lumbar portion of the conformable panel to occupy a second lumbar support configuration.

7. The chair of claim 6, wherein the lever is pivotable relative to the base about a pivot axis, the panel support is translatable relative to the base along a translation direction, and the translation direction is substantially perpendicular to the pivot axis.

8. The chair of claim 6, wherein the lumbar support mechanism is a first lumbar support mechanism coupled to a first side of the frame, the base is a first base, the lever is a first lever, the shaft is a first shaft, the cam is a first cam, and the panel support is a first panel support, and wherein the back portion further comprises a second lumbar support mechanism coupled to a second side of the frame, the second lumbar support mechanism comprising:

a second base coupled to the frame;

a second lever pivotably coupled to the second base, the second lever comprising a second shaft and a second cam coupled to and being pivotable with the second shaft relative to the second base; and a second panel support translatably coupled to the second base and engaged with the second cam, wherein the second lever is pivotable relative to the second base to cause the second cam to slide along the second panel support and translate the second panel support from a first position to a second position, in the first position the second panel support urging the lumbar portion of the conformable panel to occupy a first lumbar support configuration and in the second position the second panel support urging the lumbar portion of the conformable panel to occupy a second lumbar support configuration.

9. A chair comprising:

a back portion configured to engage a back of an occupant of the chair, comprising:

a frame;

a conformable panel coupled to the frame and configured to engage the back of the occupant of the chair, the conformable panel comprising a lumbar portion;

a lumbar support mechanism coupled to the frame, the lumbar support mechanism comprising:

a base coupled to the frame;

a leg pivotably coupled to the base, the leg comprising:

an upper leg portion configured to be pivoted by a user relative to the base;

a foot portion coupled to and being pivotable with the upper leg portion relative to the base, the foot portion comprising a heel portion and a toe portion;

a panel support translatably coupled to the base and engaged with the foot portion, the panel support comprising a support plate, wherein the leg is pivotable relative to the base to cause the toe portion to slide against the support plate and translate the support plate relative to the base, the panel support thereby applying a force to the lumbar portion of the conformable panel.

10. The chair of claim 9, wherein the leg is pivotable relative to the base about a pivot axis, the panel support is translatable relative to the base along a translation direction, and the translation direction is substantially perpendicular to the pivot axis.

11. The chair of claim 9, wherein the lumbar support mechanism is a first lumbar support mechanism coupled to a first side of the frame, the base is a first base, the leg is a first leg, the upper leg portion is a first upper leg portion, the foot portion is a first foot portion, the heel portion is a first heel portion, the toe portion is a first toe portion, and the panel support is a first panel support, and wherein the back portion further comprises a second lumbar support mechanism coupled to a second side of the frame, the second lumbar support mechanism comprising:

a second base coupled to the frame;

a second leg pivotably coupled to the second base, the second leg comprising:

a second upper leg portion configured to be pivoted by a user relative to the second base;

a second foot portion coupled to and being pivotable with the second upper leg portion relative to the second base, the second foot portion comprising a second heel portion and a second toe portion;

a second panel support translatably coupled to the second base and engaged with the second foot portion, wherein the second leg is pivotable relative to the second base to cause the second foot portion to slide against the second panel support and translate the second panel support relative to the second base, the second panel support thereby applying a force to the lumbar portion of the conformable panel.

* * * * *